US010518159B1

(12) United States Patent
Rosencrans

(10) Patent No.: US 10,518,159 B1
(45) Date of Patent: Dec. 31, 2019

(54) SOFT-TOSS PITCHING MACHINE

(71) Applicant: William Rosencrans, Niles, IL (US)

(72) Inventor: William Rosencrans, Niles, IL (US)

( * ) Notice: Subject to any disclaimer, the term of this patent is extended or adjusted under 35 U.S.C. 154(b) by 0 days.

(21) Appl. No.: 16/218,997

(22) Filed: Dec. 13, 2018

(51) Int. Cl.
*A63B 69/00* (2006.01)
*A63B 69/40* (2006.01)
*A63B 47/00* (2006.01)

(52) U.S. Cl.
CPC ..... *A63B 69/406* (2013.01); *A63B 69/0002* (2013.01); *A63B 47/002* (2013.01); *A63B 2069/0008* (2013.01); *A63B 2069/401* (2013.01)

(58) Field of Classification Search
CPC ..... A63B 69/406; A63B 69/0002; A63B 47/0008; A63B 2069/401
USPC ..... 473/451, 454, 455, 422; 124/6, 7, 4, 16, 124/36, 41, 1, 81
See application file for complete search history.

(56) References Cited

U.S. PATENT DOCUMENTS 2,080,958 A * 5/1937 Beasley ..... A63B 69/408 124/36
2,700,379 A 1/1955 Brigati
3,470,859 A * 10/1969 Ponza ..... A63B 69/408 124/36
3,601,111 A * 8/1971 Embry ..... A63B 69/408 124/7
3,760,787 A 9/1973 Kahelin
4,074,905 A 2/1978 High
4,262,648 A 4/1981 Wegener
4,269,162 A 5/1981 Abraham
4,271,813 A * 6/1981 Rowe ..... A63B 69/408 124/34
4,409,953 A 10/1983 Kennedy
4,860,717 A * 8/1989 Powell ..... A63B 69/408 124/7
4,906,001 A * 3/1990 Vaughn ..... A63B 69/0075 124/36
5,121,735 A 6/1992 Hancock
5,464,208 A 11/1995 Pierce
5,660,386 A * 8/1997 Krieger ..... A63B 69/407 124/7
5,927,262 A 5/1999 Bixler
5,975,527 A * 11/1999 Winchester ..... A63B 69/408 124/36
6,129,076 A * 10/2000 Powell ..... A63B 69/408 124/36
7,066,846 B2 * 6/2006 Horkan ..... A63B 69/002 124/7
7,628,147 B2 12/2009 Estalella
(Continued)

*Primary Examiner* — Mitra Aryanpour

(57) ABSTRACT

A soft-toss pitching machine for soft-pitch practice includes a housing and a feeder tube coupled within an inside of the housing and extending from a feed aperture to a dispense aperture. A plurality of legs is coupled to the housing. A swivel is coupled to the housing and a pitcher arm is coupled to the swivel. The pitcher arm has a rest position, a first alternate wound position, and a second alternate release position in front of the housing. A pitcher hand is coupled to the pitcher arm and is configured to secure a ball with the pitcher arm in, and moving between, the rest position and the first alternate wound position. The pitcher hand is configured to release the ball when the pitcher arm moves to the release position. A drive is in operational communication with the swivel and moves the pitcher arm.

9 Claims, 5 Drawing Sheets

(56) References Cited

U.S. PATENT DOCUMENTS

| | | | | |
|---|---|---|---|---|
| 9,238,164 | B2 * | 1/2016 | Perry, Jr. ..... | A63B 69/407<br>124/6 |
| 9,981,174 | B1 * | 5/2018 | Decilveo ..... | A63B 69/408<br>124/6 |
| 2016/0250536 | A1 * | 9/2016 | Hart ..... | A63B 69/40<br>124/7 |

* cited by examiner

SOFT-TOSS PITCHING MACHINE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to pitching machines and more particularly pertains to a new pitching machine for soft-pitch practice.

BRIEF SUMMARY OF THE INVENTION

An embodiment of the disclosure meets the needs presented above by generally comprising a housing having a front side, a rear side, a top side, a bottom side, a left side and a right side. The front side, the rear side, the top side, the bottom side, the left side, and the right side form an inside therebetween. The top side has a feed aperture extending through to the inside. The left side has a dispense aperture and a pivot aperture each extending through to the inside. A plurality of legs is coupled to the housing. A feeder tube is coupled within the inside of the housing and extends from the feed aperture to the dispense aperture. A swivel is coupled to the left side of the housing adjacent the pivot aperture. A pitcher arm is coupled to the swivel. The pitcher arm has a rest position, a first alternate wound position behind the housing, and a second alternate release position in front of the housing. The pitcher arm extends from the swivel to above the feed aperture in the rest position. A pitcher hand is coupled to the pitcher arm and is adjacent the feed aperture in the rest position. The pitcher hand is configured to secure a ball with the pitcher arm in, and moving between, the rest position and the first alternate wound position. The pitcher hand is configured to release the ball when the pitcher arm moves to the release position. A drive is coupled to the inside of the housing and extends through the pivot aperture. The drive is in operational communication with the swivel and moves the pitcher arm from the rest position to the second alternate release position, from the second alternate release position to the first alternate wound position, from the first alternate wound position to the second alternate release position, and from the second alternate release position to the rest position. A power source is coupled within the inside of the housing and is in operational communication with, and provides power to, the drive.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
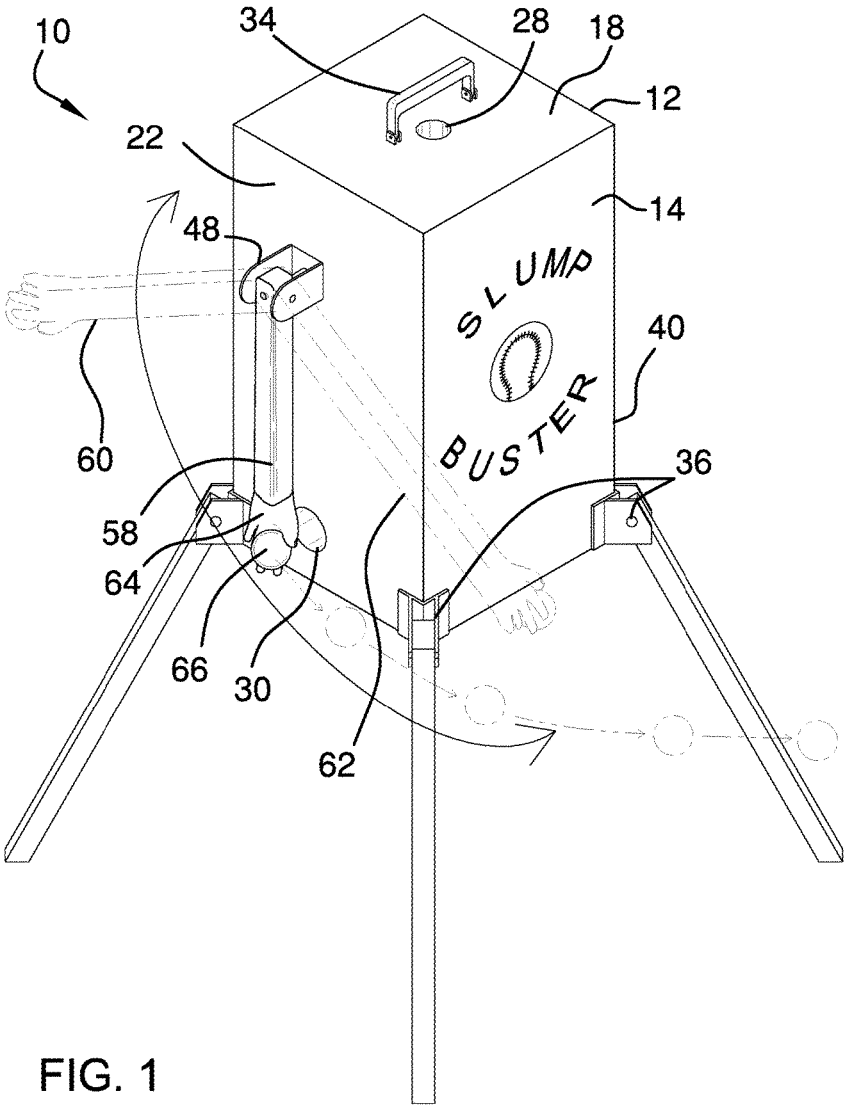
FIG. 1 is an isometric view of a soft-toss pitching machine according to an embodiment of the disclosure.
Figure 2:
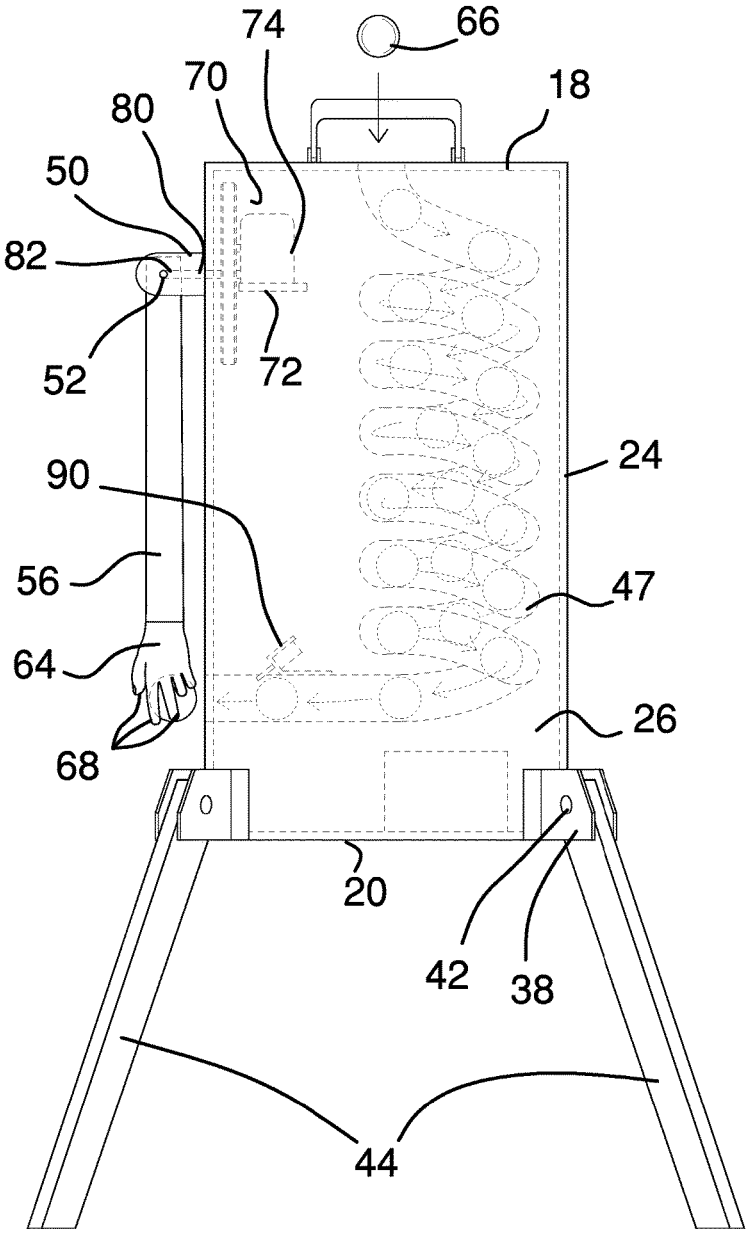
FIG. 2 is a front elevation view of an embodiment of the disclosure.
Figure 3:
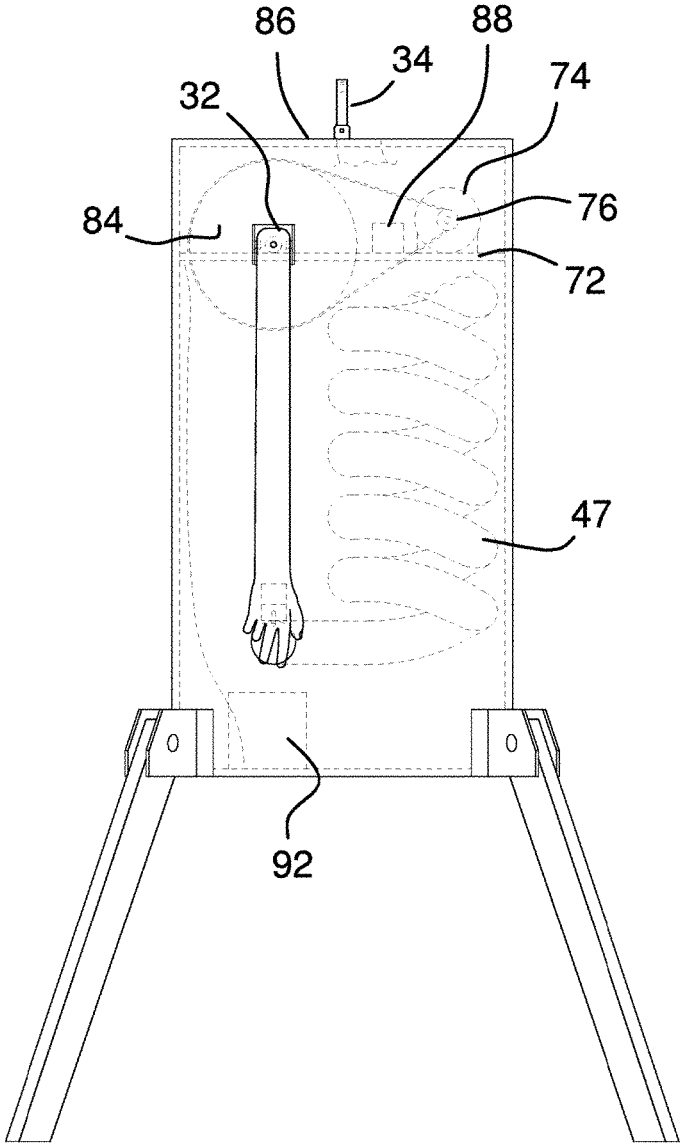
FIG. 3 is a side elevation view of an embodiment of the disclosure.
Figure 4:
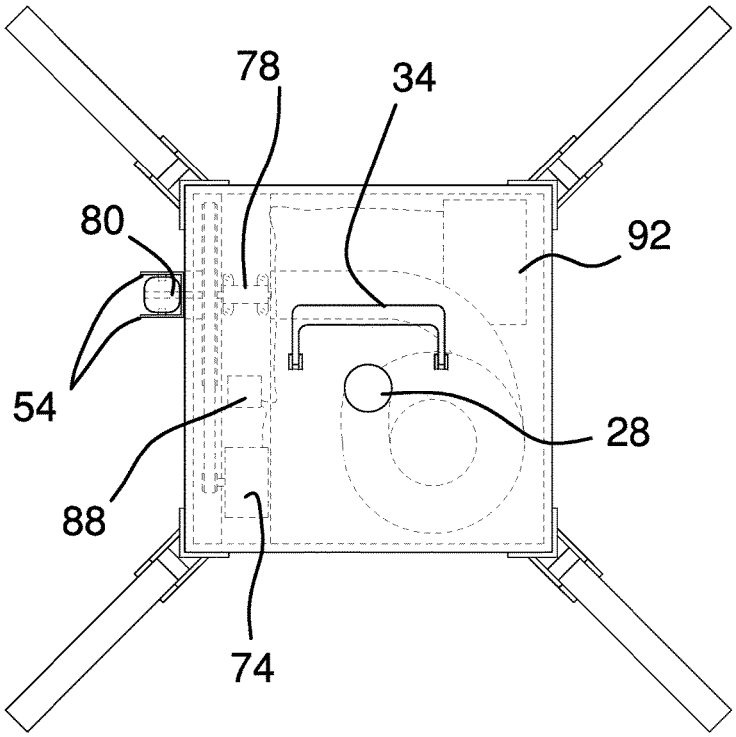
FIG. 4 is a top plan view of an embodiment of the disclosure.
Figure 5:
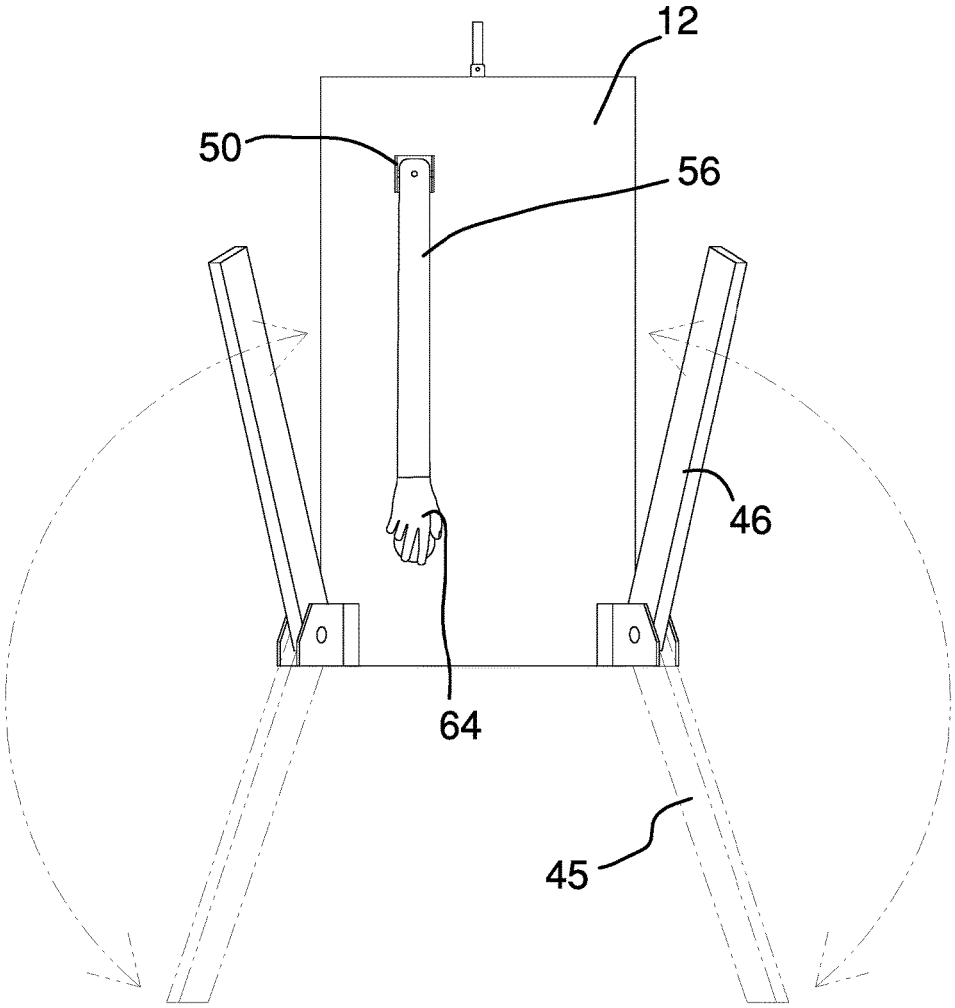
FIG. 5 is a detail view of an embodiment of the disclosure.

With reference now to the drawings, and in particular to FIGS. 1 through 5 thereof, a new pitching machine embodying the principles and concepts of an embodiment of the disclosure and generally designated by the reference numeral 10 will be described.

As best illustrated in FIGS. 1 through 5, the soft-toss pitching machine 10 generally comprises a housing 12 having a front side 14, a rear side 16, a top side 18, a bottom side 20, a left side 22 and a right side 24, the front side 14, the rear side 16, the top side 18, the bottom side 20, the left side 22, and the right side 24 forming an inside 26 therebetween. The top side 18 has a feed aperture 28 extending through to the inside 26. The left side 22 has a dispense aperture 30 and a pivot aperture 32 each extending through to the inside 26. A handle 34 may be coupled to the housing. The handle 34 is pivotably attached to the top side 18 proximal the feed aperture 28. A plurality of leg pivots 36 may be coupled to the housing 12. Each of the plurality of leg pivots 36 has a mounting bracket 38 coupled to an edge 40 of the housing adjacent the bottom side 20 and a hinge 42 coupled to the mounting bracket 38. A plurality of legs 44 is coupled to the hinge 42 of the plurality of leg pivots and pivots between an extended position 45 and an alternate folded position 46. The extended position 45 places the housing 12 at the appropriate height for use and the alternate folded position 46 is used for transportation and storage. A feeder tube 47 is coupled within the inside 26 of the housing and extends from the feed aperture 28 to the dispense aperture 30. The feeder tube 47 may be spiral to optimize the total length and thus the total number of balls that can be fit within the housing 12.

A swivel 48 is coupled to the housing 12 and may comprise a swivel bracket 50 and a pivot pin 52. The swivel bracket 50 is pivotably coupled to the left side 22 of the housing around the pivot aperture 32 and has a pair of extensions 54. The pivot pin 52 is pivotably coupled to each of the pair of extensions 54. A pitcher arm 56 is coupled to the swivel 48. The pitcher arm 56 is coupled to the pivot pin 52, and has a rest position 58, a first alternate wound position 60 behind the housing 12, and a second alternate release position 62 in front of the housing 12. The pitcher arm 56 extends from the swivel 48 to above the feed aperture 28 in the rest position 58. A pitcher hand 64 is coupled to the pitcher arm 56 and is adjacent the feed aperture 28 in the rest position 58. The pitcher hand 64 is configured to secure a ball 66 with the pitcher arm 56 in and moving between the rest position 58 and the first alternate wound position 60. The pitcher hand 64 is configured to release the ball 66 when the pitcher arm 56 moves to the release position 62 to replicate a short-toss or soft-toss style pitch. The pitcher hand 64 may have a plurality of fingers 68 and may be human hand shaped to replicate a live pitcher.

A drive 70 is coupled to the housing and may comprise a mounting shelf 72 coupled below the pivot aperture 32 within the inside 26 of the housing. A stepper motor 74 is coupled to the mounting shelf 72. A small pulley 76 is coupled to the stepper motor 74. A mounting block 78 is coupled to the mounting shelf in line with the pivot aperture 32. A shaft 80 is pivotably coupled to the mounting block 78. The shaft 80 has a distal end 82 extending through the pivot aperture 32 and coupled to the swivel 48. A large pulley 84 is coupled to the shaft 80 adjacent the mounting block 78. A pulley belt 86 is coupled to each of the large pulley 84 and the small pulley 76. A microprocessor 88 is coupled to the mounting shelf 72 and is in operational communication with the stepper motor 74. The drive 70 moves the pitcher arm 56 from the rest position 58 to the second alternate release position 62 slowly enough to not release the ball 66, from the second alternate release position 62 to the first alternate wound position 60, from the first alternate wound position 60 to the second alternate release position 62 to release the ball 66, and from the second alternate release position 62 to the rest position 58. The drive 70 has a plurality of settings to pitch the ball 66 as a strike, a bluff where the ball 66 is not released, a loop to release the ball 66 on a higher flight path, a mixture of strikes and balls, and a random setting combining the previous settings. The drive 70 may also have a plurality of distance settings to pitch the ball 66 different distances including, but not limited to, 10 feet, 15 feet, 20 feet, and 25 feet. A solenoid ball gate 90 may be coupled to the feeder tube 46 proximal the dispense aperture 30. The solenoid ball gate 90 is in operational communication with the microprocessor 88 and is configured to allow the ball 66 to pass through the dispense aperture 30 to the pitcher hand 64. A power source 92 is coupled within the inside 26 of the housing. The power source 92 is in operational communication with, and provides power to, the drive 70 and the solenoid ball gate 90.

In use, a plurality of balls is placed into the feed aperture 28 to fill the feeder tube 47. The solenoid ball gate 90 then releases the ball 66 through the dispense aperture 30 into the pitcher hand 64. The stepper motor 74 then moves the pitcher arm 56 from the rest position 58 to the first alternate wound position 60 to simulate the wind of a pitching motion, from the first alternate wound position 60 to the second alternate release position 62 to release and pitch the ball 66, and from the second alternate release position 62 to the rest position 58 to ready the soft-toss pitching machine 10 for the next pitch.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A soft-toss pitching machine comprising:

a housing having a front side, a rear side, a top side, a bottom side, a left side and a right side, the front side, the rear side, the top side, the bottom side, the left side, and the right side forming an inside therebetween, the top side having a feed aperture extending through to the inside, the left side having a dispense aperture and a pivot aperture each extending through to the inside;

a plurality of legs coupled to the housing;

a feeder tube coupled to the housing, the feeder tube being coupled within the inside of the housing and extending from the feed aperture to the dispense aperture;

a swivel coupled to the housing, the swivel being coupled to the left side adjacent the pivot aperture;

a pitcher arm coupled to the swivel, the pitcher arm having a rest position, a first alternate wound position behind the housing, and a second alternate release position in front of the housing, the pitcher arm extending from the swivel to above the feed aperture in the rest position;

a pitcher hand coupled to the pitcher arm, the pitcher hand being adjacent the feed aperture in the rest position, the pitcher hand being configured to secure a ball with the pitcher arm in, and moving between, the rest position and the first alternate wound position, the pitcher hand being configured to release the ball when the pitcher arm moves to the release position;

a drive coupled to the housing, the drive being coupled within the inside and extending through the pivot aperture, the drive being in operational communication with the swivel, the drive moving the pitcher arm from the rest position to the second alternate release position, from the second alternate release position to the first alternate wound position, from the first alternate wound position to the second alternate release position, and from the second alternate release position to the rest position; and a power source coupled to the housing, the power source being coupled within the inside, the power source being in operational communication with, and providing power to, the drive.

2. The soft-toss pitching machine of claim 1 further comprising the drive comprising:

a mounting shelf coupled to the housing, the mounting shelf being coupled below the pivot aperture within the inside of the housing;

a stepper motor coupled to the housing, the stepper motor being coupled to the mounting shelf;

a small pulley coupled to the stepper motor;

a mounting block coupled to the mounting shelf, the mounting block being in line with the pivot aperture;

a shaft coupled to the mounting block, the shaft being pivotably coupled to the mounting block, the shaft having a distal end extending through the pivot aperture, the distal end being coupled to the swivel;

a large pulley coupled to the shaft, the large pulley being coupled to the shaft adjacent the mounting block;

a pulley belt coupled to each of the large pulley and the small pulley; and a microprocessor coupled to the mounting shelf, the microprocessor being in operational communication with the stepper motor.

3. The soft-toss pitching machine of claim 1 further comprising the swivel comprising:

a swivel bracket coupled to the housing, the swivel bracket being pivotably coupled to the left side of the housing around the pivot aperture, the swivel bracket having a pair of extensions; and a pivot pin coupled to the swivel bracket, the pivot pin being pivotably coupled to each of the pair of extensions, the pitcher arm being coupled to the pivot.

4. The soft-toss pitching machine of claim 2 further comprising a solenoid ball gate coupled to the feeder tube, the solenoid ball gate being coupled proximal the dispense aperture, the solenoid ball gate being in operational communication with each of the microprocessor and the power source, the solenoid ball gate being configured to allow the ball to pass through the dispense aperture to the pitcher hand.

5. The soft-toss pitching machine of claim 2 further comprising the feeder tube being spiral.

6. The soft-toss pitching machine of claim 2 further comprising the pitcher hand having a plurality of fingers, the pitcher hand being human hand shaped to replicate a live pitcher.

7. The soft-toss pitching machine of claim 4 further comprising a plurality of leg pivots coupled to the housing, each of the plurality of leg pivots having a mounting bracket and a hinge, the mounting bracket being coupled to an edge of the housing adjacent the bottom side, the hinge being coupled to the mounting bracket, the plurality of legs being coupled to the hinge of the plurality of leg pivots, the plurality of legs having an extended position and an alternate folded position.

8. The soft-toss pitching machine of claim 6 further comprising a handle coupled to the housing, the handle being pivotably attached to the top side proximal the feed aperture.

9. A soft-toss pitching machine comprising:

a housing having a front side, a rear side, a top side, a bottom side, a left side and a right side, the front side, the rear side, the top side, the bottom side, the left side, and the right side forming an inside therebetween, the top side having a feed aperture extending through to the inside, the left side having a dispense aperture and a pivot aperture each extending through to the inside;

a handle coupled to the housing, the handle being pivotably attached to the top side proximal the feed aperture;

a plurality of leg pivots coupled to the housing, each of the plurality of leg pivots having a mounting bracket and a hinge, the mounting bracket being coupled to an edge of the housing adjacent the bottom side;

a plurality of legs coupled to the housing, the plurality of legs being coupled to the hinge of the plurality of leg pivots, the hinge being coupled to the mounting bracket, the plurality of legs having an extended position and an alternate folded position;

a feeder tube coupled to the housing, the feeder tube being coupled within the inside of the housing and extending from the feed aperture to the dispense aperture, the feeder tube being spiral;

a swivel coupled to the housing, the swivel comprising:

a swivel bracket coupled to the housing, the swivel bracket being pivotably coupled to the left side of the housing around the pivot aperture, the swivel bracket having a pair of extensions; and a pivot pin coupled to the swivel bracket, the pivot pin being pivotably coupled to each of the pair of extensions;

a pitcher arm coupled to the swivel, the pitcher arm being coupled to the pivot pin, the pitcher arm having a rest position, a first alternate wound position behind the housing, and a second alternate release position in front of the housing, the pitcher arm extending from the swivel to above the feed aperture in the rest position;

a pitcher hand coupled to the pitcher arm, the pitcher hand being adjacent the feed aperture in the rest position, the pitcher hand being configured to secure a ball with the pitcher arm in, and moving between, the rest position and the first alternate wound position, the pitcher hand being configured to release the ball when the pitcher arm moves to the release position, the pitcher hand having a plurality of fingers, the pitcher hand being human hand shaped to replicate a live pitcher;

a drive coupled to the housing, the drive comprising:

a mounting shelf coupled to the housing, the mounting shelf being coupled below the pivot aperture within the inside of the housing;

a stepper motor coupled to the housing, the stepper motor being coupled to the mounting shelf;

a small pulley coupled to the stepper motor;

a mounting block coupled to the mounting shelf, the mounting block being in line with the pivot aperture;

a shaft coupled to the mounting block, the shaft being pivotably coupled to the mounting block, the shaft having a distal end extending through the pivot aperture, the distal end being coupled to the swivel;

a large pulley coupled to the shaft, the large pulley being coupled to the shaft adjacent the mounting block;

a pulley belt coupled to each of the large pulley and the small pulley; and a microprocessor coupled to the mounting shelf, the microprocessor being in operational communication with the stepper motor;

wherein the drive moves the pitcher arm from the rest position to the second alternate release position, from the second alternate release position to the first alternate wound position, from the first alternate wound position to the second alternate release position, and from the second alternate release position to the rest position;

a solenoid ball gate coupled to the feeder tube, the solenoid ball gate being coupled proximal the dispense aperture, the solenoid ball gate being in operational communication with the microprocessor, the solenoid ball gate being configured to allow the ball to pass through the dispense aperture to the pitcher hand; and a power source coupled to the housing, the power source being coupled within the inside, the power source being in operational communication with, and providing power to, the drive and the solenoid ball gate.

* * * * *